US008918918B2

(12) United States Patent
Jackson

(10) Patent No.: US 8,918,918 B2
(45) Date of Patent: Dec. 30, 2014

(54) APPARATUS FOR PREVENTING NECK INJURY, SPINAL CORD INJURY AND CONCUSSION

(71) Applicant: Kevin J. Jackson, York, PA (US)

(72) Inventor: Kevin J. Jackson, York, PA (US)

( * ) Notice: Subject to any disclaimer, the term of this patent is extended or adjusted under 35 U.S.C. 154(b) by 287 days.

(21) Appl. No.: 13/627,104

(22) Filed: Sep. 26, 2012

(65) Prior Publication Data

US 2014/0053324 A1 Feb. 27, 2014

Related U.S. Application Data

(60) Provisional application No. 61/691,980, filed on Aug. 22, 2012.

(51) Int. Cl.
*A63B 71/10* (2006.01)

(52) U.S. Cl.
USPC ..... 2/425

(58) Field of Classification Search
CPC ..... A63B 71/10
USPC ..... 2/425, 410, 44, 421; 602/18
See application file for complete search history.

(56) References Cited

U.S. PATENT DOCUMENTS

| | | | | |
|---|---|---|---|---|
| 3,148,375 | A * | 9/1964 | Jones | 2/421 |
| 3,671,974 | A | 6/1972 | Sims | |
| 3,818,509 | A | 6/1974 | Romo et al. | |
| 5,123,408 | A | 6/1992 | Gaines | |
| 5,272,770 | A | 12/1993 | Allen et al. | |
| 5,517,699 | A | 5/1996 | Abraham, II | |
| 6,481,026 | B1 | 11/2002 | McIntosh | |
| 6,968,576 | B2 | 11/2005 | McNeil et al. | |
| 7,941,873 | B2 | 5/2011 | Nagely et al. | |
| 8,074,301 | B2 * | 12/2011 | Mothaffar | 2/468 |
| 8,341,770 | B2 * | 1/2013 | Siegler et al. | 2/411 |
| 8,375,472 | B2 * | 2/2013 | Ashline | 2/421 |
| 8,528,113 | B2 * | 9/2013 | Siegler et al. | 2/6.8 |
| 2004/0055077 | A1 * | 3/2004 | Wright | 2/421 |
| 2011/0060260 | A1 * | 3/2011 | Siegler et al. | 602/18 |

* cited by examiner

*Primary Examiner* — Khoa Huynh
*Assistant Examiner* — Anna Kinsaul
(74) *Attorney, Agent, or Firm* — McNees Wallace & Nurick LLC

(57) ABSTRACT

An apparatus for preventing neck injury, spinal cord injury and concussion is disclosed. The apparatus includes a helmet, a body harness and a plurality of anchor assemblies connecting the helmet to the body harness. The anchor assemblies are adjustable to limit the cervical rotation, lateral bending, flexion and extension ranges of motion of a wearer to a predetermined set point, each anchor assembly including a plurality of guide cords extending from the helmet to an anchor of the anchor assembly, the plurality of guide cords being attached to, but individually adjustable with respect to, the anchor.

5 Claims, 3 Drawing Sheets

APPARATUS FOR PREVENTING NECK INJURY, SPINAL CORD INJURY AND CONCUSSION

RELATED APPLICATIONS

This application claims the benefit of and priority to U.S. Provisional Patent Application 61/691,980 filed Aug. 22, 2012, which is incorporated by reference in its entirety.

FIELD OF THE INVENTION

The present invention is directed to a device for preventing neck injury, spinal cord injury and concussion.

BACKGROUND OF THE INVENTION

A common problem faced in today's amateur and professional sports, particularly in contact sports such as hockey, football and lacrosse, is the issue of neck injury, spinal cord injury and concussion. Concussion can be caused by direct contact to the head, but also as a result of acceleration forces, both linear and rotational, to the neck and head. These forces may be experienced during a body check or tackle even without direct contact to the head. The effect of the force during such an event results in movement of the brain against the skull that causes disruption of cell function. Concussions can also occur from rotation, lateral bending, flexion and extension of the spinal cord, brain stem and blood vessels located in the upper cervical area around the C1/C2 vertebral motor unit, which can occur during impact of a body check or tackle in which a resultant whipping of the neck and head happens much like that in a motor vehicle accident. In either case, concussions result in altered brain function that may last for days, months or even years, and can also lead to depression and early onset dementia.

To reduce the risk of concussions and spinal cord injuries, participants in contact sports, such as football, field hockey, lacrosse and ice hockey, wear protective helmets to shield the head and skull area from impact injuries. Helmet technology has sought to address problems with concussions; new foam headlines are being used inside helmets, often in combination with thicker, stronger and lighter plastic shells. Furthermore, sports leagues have taken efforts to make rule changes to reduce concussions, such as limiting body-checking and eliminating blind side hits or helmet to helmet contact.

Despite these advances in helmet technology and rule changes, instances of concussion continue to increase at alarming rates. While rule changes and advances in helmet technology have been significant in reducing direct impact injuries from blows to the head, any force applied to the helmet still moves the entire head. Thus, concussions and spinal cord injuries that occur as a result of acceleration/deceleration forces continue to occur; helmet technology advances also do not address other potential brain and spinal cord injury.

While prior attempts to reduce the risk of neck injuries from helmet motions have been addressed, these prior attempts have been largely unsatisfactory for a variety of reasons.

Prior art devices for preventing neck injury are centrally located on the helmet and fasten the helmet rigidly to a support structure such that safe and effective play is not possible due to restrictions in the participant's head motion, and thus to his or her vision and responsiveness. Exposed fasteners to the helmet present a hazard of injury to other players and in the case of entanglement, unexpected and potentially injurious head movement to the participant wearing the helmet. Elastic straps attached to the helmet induce unnecessary fatigue to the participant during the course of the event.

A device for preventing neck injury, spinal cord injuries and concussion that does not suffer from one or more of the above drawbacks or other deficiencies in the current art would be desirable.

SUMMARY

In an exemplary embodiment, an apparatus for preventing neck injury, spinal cord injury and concussion comprises a helmet, a body harness and a plurality of anchor assemblies connecting the helmet to the body harness. The anchor assemblies are adjustable to limit the cervical rotation, lateral bending, flexion and extension ranges of motion of a wearer to a predetermined set point, each anchor assembly including a plurality of guide cords extending from the helmet to an anchor of the anchor assembly, the plurality of guide cords being attached to, but individually adjustable with respect to, the anchor.

In some embodiments, the anchor may be a two-part, quick release device having a cleat for receiving and securing the guide cords and a cleat seat permanently attached to the body harness. In this manner, the helmet can be removed without having to re-adjust the guide cords or the point of attachment on the body harness.

One advantage of exemplary embodiments is that a device is provided that prevents against injury without restricting a participant's cervical rotation, lateral bending, flexion and extension range of motion.

Another advantage of exemplary embodiments is that the device prevents injury while minimizing the risk to other players that might come into contact with the device.

Still another advantage of exemplary embodiments is that the device does not interfere with the user's ability to remove his or her helmet without requiring the device to be readjusted.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF EXEMPLARY EMBODIMENTS

Provided is an exemplary device for preventing neck injury according to the disclosure. Embodiments of the disclosure provide for a device that does not restrict a participant's cervical rotation, lateral bending, flexion and extension range of motion; does not expose other players to the hazards of exposed fasteners; and does not unduly fatigue the participant from elastic straps.

Figure 1:
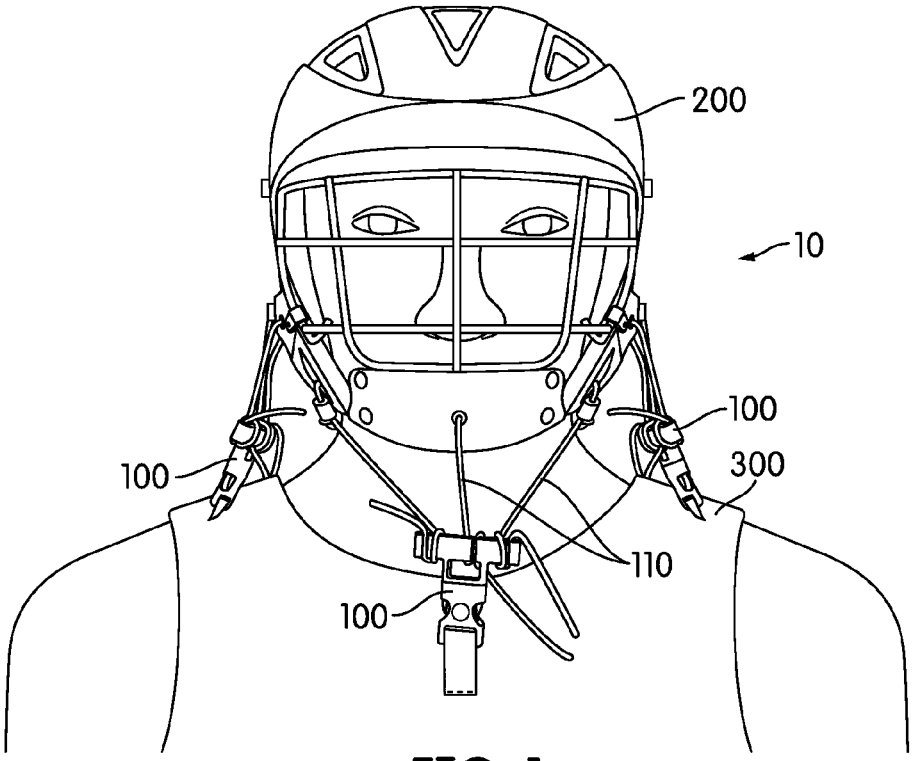
FIG. 1 is a front view of a device for preventing neck injury in accordance with an exemplary embodiment.
Figure 2:
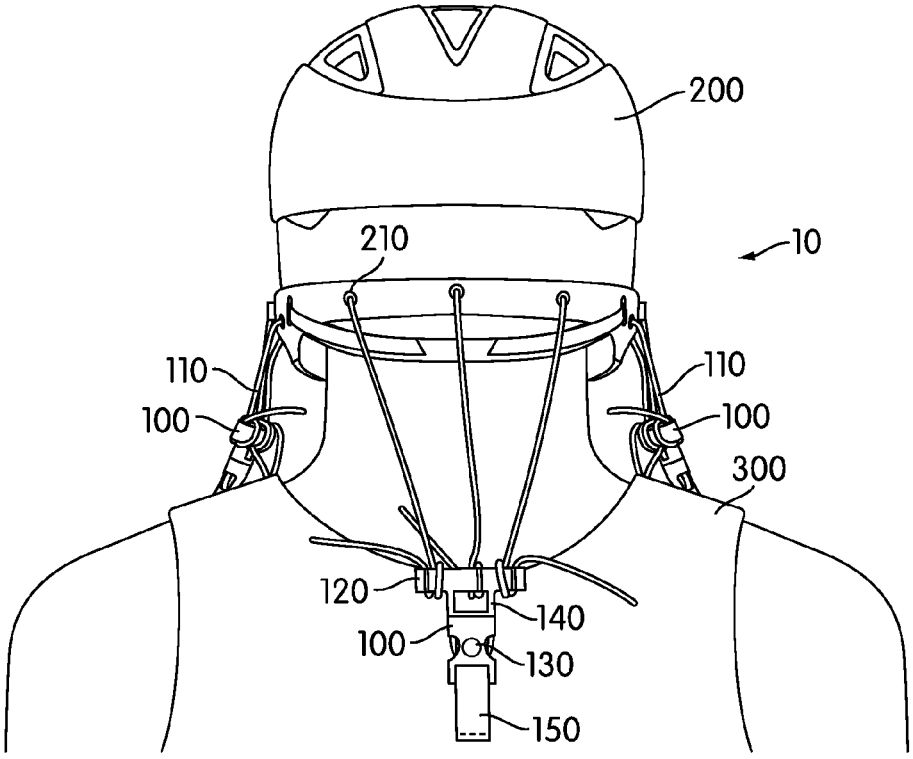
FIG. 2 is a rear view of the device shown in FIG. 1.
Figure 3:
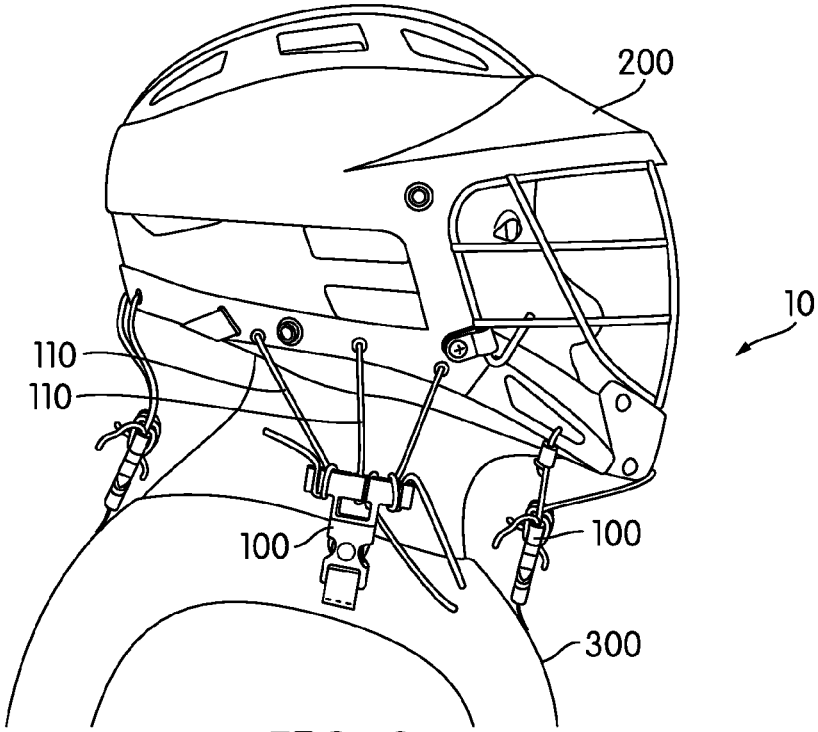
FIGS. 3 and 4 are side views of the device shown in FIG. 1.

Referring to FIGS. 1-3, a device 10 for preventing neck injury includes an anchor assembly 100, helmet 200, and body harness 300. Although the helmet 200 shown in the drawings is illustrated as a lacrosse helmet, it will be appreciated that any style of helmet for use in any type of sport may be used in conjunction with the device 10 including, without limitation, lacrosse, football, hockey, racing, and bicycling, all by way of example only. In the same manner, the body harness 300 may be any harness of the types that are now known or later may be developed to be worn by an individual including, without limitation, shoulder pads, protective vests, seat belts, and five point harness, all by way of example.

The anchor assembly 100 connects the helmet 200 to the body harness 300 and is adjustable to limit the wearer's range of cervical rotation, lateral bending, flexion and extension ranges of motion. This may advantageously be achieved by providing anchor assemblies 100 on each of the front, back and both sides of the device as illustrated in FIGS. 1-3. It will be appreciated that this arrangement is not the only one by which that goal could be achieved and that as few as three and as many as five, six or more anchor assemblies 100 may be distributed on the device about the wearer.

The anchor assembly 100 includes an anchor 140 as well as a plurality of guide cords 110 that are securely attached at one end to the helmet 200; in the illustrated embodiment, each anchor assembly 100 employs three guide cords 110. The guide cords 110 are preferably nylon parachute cord or nylon sport cord, which in either case may be capable of absorbing over 500 pounds of force (i.e., having a tensile strength of at least 500 pounds).

Figure 6:
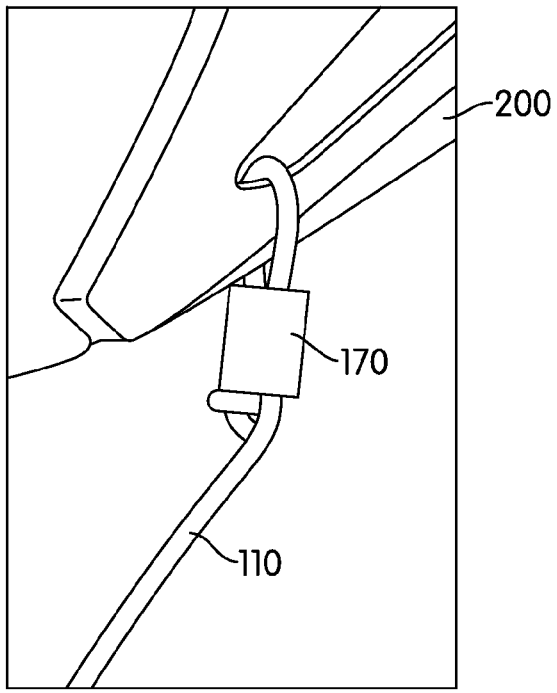
FIG. 6 is an enlarged view of one alternative manner of attaching the guide cords to the helmet.

The guide cords 110 may be permanently attached to the helmet 200 to reduce the likelihood of one or more of them becoming detached during use. Any manner of securely attaching one end of the guide cord 110 to the helmet 200 may be employed. One manner of securely attaching the guide cords 110 to the helmet 200 is through the use of grommets 210 (best seen in FIG. 2) formed in the helmet. FIG. 6 illustrates an alternative method of securely attaching the guide cord 110 to the helmet 200 using a clamp 170 to attach the guide cord 110 around a portion of the helmet 200 and also to itself, which may be preferred for certain locations on the helmet such as the face guard and/or for helmet styles having other areas that would not readily accommodate a grommet 210.

Figure 4:
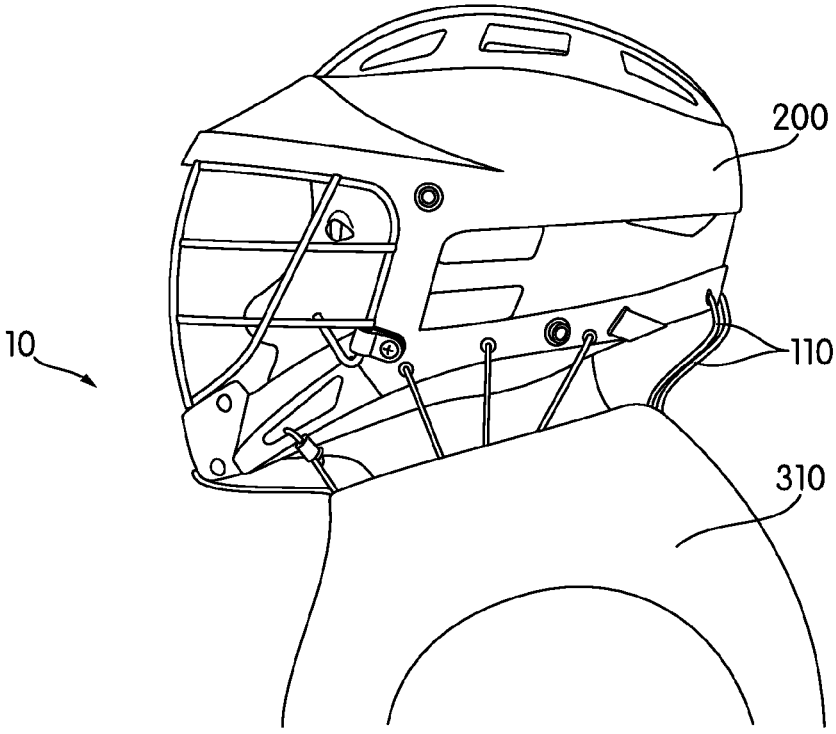

The other end of each guide cord 110 is adjustably secured to the anchor 140 that is itself securely attached to the body harness 300. In one embodiment, the anchor 140 may be stitched directly to the body harness 300. Alternatively, the anchor 140 may employ a piece of nylon or other webbing 150 as an intermediate piece. Any other suitable method of attaching the anchor 140 to the body harness 300 may also be employed and it will be appreciated that, as with the guide cords 110 to the helmet 200, multiple methods of securing the anchor 140 to the harness 300 may be used in a single device 10 based on the style of the harness 300. In one embodiment, the anchor 140 is preferably secured sufficiently close to the harness 300 so that anchor 140 is concealed by the wearer's jersey 310 (FIG. 4) along with the body harness 300 when in use. This limits potential injury that may occur by other players coming into contact with the exposed anchor 140, or unexpected and potentially injurious head movement in the case of entanglement, although at least a portion of the guide cords 110 ordinarily remain exposed.

The anchor 140 has a cleat 120 and a cleat seat 130. Preferably, the anchor 140 is a two-piece quick release device such that the cleat 120 and cleat seat 130 are capable of being selectively disengaged from one another but can be readily re-engaged to provide a secure connection. This provides an ability for the wearer to remove his or her helmet 200 without removing the body harness 300 or needing to adjust or release the guide cords 110 on the cleat 120 (as subsequently described in further detail), as may be desirable when a player is resting on the sideline of an athletic event. This may be achieved, for example, by employing a male and female buckle design for the cleat 120 and cleat seat 130 as best seen in FIG. 5.

With continuing reference to FIGS. 1-3, the cleat 120 of the anchor 140 provides an adjustable tie-off that permits the length of the guide cord 110 between the helmet 200 and the cleat 120 to be modified and, as a result, to restrict the wearer's range of motion to a predetermined limit, preventing extension beyond that pre-set limit which could result in injury to the wearer. The cleat 120 mechanically secures each of the corresponding guide cords 110 associated with that anchor position. In the exemplary embodiment, three guide cords 110 are associated with each of the front, back and side anchor positions, each guide cord 110 securely attached to the helmet 200 at a distance apart from one another and tapering downward to their common anchor 140.

The spacing of the guide cords 110, which are placed along the helmet 200 at specific intervals, is designed to allow normal cervical range of motion for the player. Normal ranges are 80 degrees for right and left rotation, 45 degrees for right and left lateral flexion, 50 degrees for flexion and 60 degrees for extension. It will be appreciated however, that the spacing to achieve these ranges may vary based on helmet design and helmet style. It will further be appreciated that normal ranges of motion may vary with age or gender, which may also be taken into consideration for the manufacture of any particular device 10.

Figure 5:
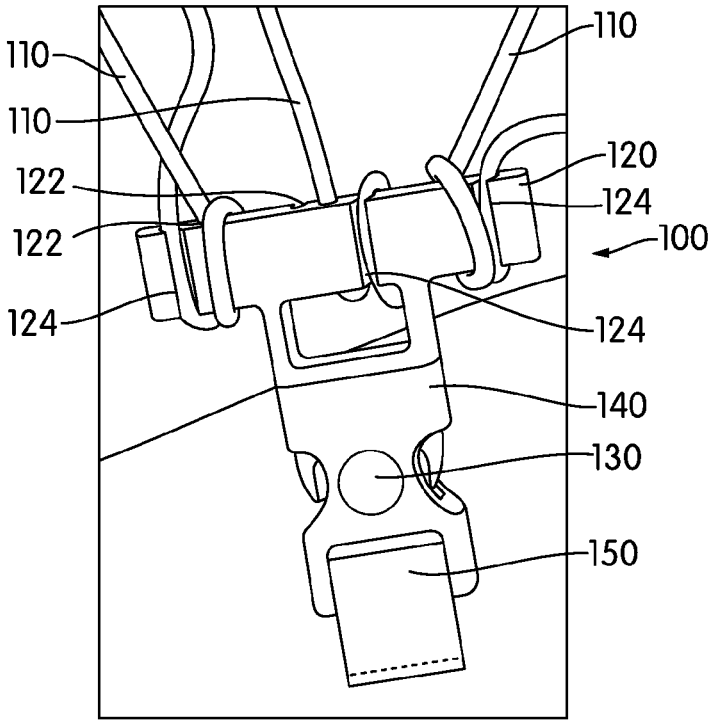
FIG. 5 is an enlarged view of the anchor assembly.

Turning to FIG. 5, an enlarged view of the anchor assembly 100 is shown and which depicts one manner in which each of the cords 110 is tied-off in the cleat 120 of the anchor 140. As illustrated, the guide cord 110 extends from the helmet 200 and the loose end is inserted through a channel or first groove 122 formed in the cleat 120. The guide cord 110 is pulled until the desired length between the helmet 200 and cleat 120 is achieved, upon which the guide cord 110 may be looped around the cleat 120 one or more times and then secured in a clip or second groove 124 formed on an opposite of the cleat 120 from the first groove 122.

The guide cords 110 are tied off in the cleat 120 with the helmet 200 on and the cleat 120 engaged with the cleat seat 130. Preferably, the predetermined length to which the cords are tied off is accomplished with the wearer's head and neck being moved at each point to the maximum comfortable cervical, flexion, or extension positions (which may be less than the normal maximum range of motion), which can most easily be achieved in a sequential manner and which can be done by the wearer, or more typically, with the aid of another individual.

That is, once the gear is donned and connected, except for the attachment of the guide cords 110 to the cleat 120, the wearer would go through each range of motion, with the guide cords 110 being secured to the cleat 120 at each range of motion. To avoid inadvertently missing some, it may be desirable to go from back to front, then left to right to make sure all guide cords 110 are tied down and locked in.

Because the guide cords 110 are tied off at the maximum range of extension desired to be experienced, the guide cords 110 do not impede the wearer's normal range of motion or vision. Instead they are ordinarily limp, becoming taut only when a force is experienced that extends the wearer to the maximum range of motion and thereby preventing the neck and/or head from moving beyond that point. Instead of the force of impact being absorbed by the wearer and more particularly his or her head and neck, the force is distributed to the helmet 200 and body harness 300. Thus, the device 10 is designed to absorb linear and rotational acceleration forces into the equipment and not into the cervical spine, blood vessels, brain stem and brain of the wearer, reducing the likelihood of a concussion or other neck or spine injury.

When the anchor assembly 100, helmet 200 and body harness 300 are properly fitted and secured, the device 10 allows for free variable range of motion that can be customized for each specific wearer. For example, as previously noted, some players will have 80 degrees of right/left range of motion, while others might only have 70 degrees. The device 10 allows for this variance from player to player by tying off the guide cords 110 at each individual's maximum level of comfort. Once that normal range of motion is established and locked in, the wearer's helmet will not rotate, laterally flex, flex or extend past the preset range of motion determined by the anchor assembly 100. When a body check or tackle does occur with a great force, the cervical spine will be allowed to rotate to that particular wearer's normal, but not beyond. The excess movement and force is absorbed into the device 10 via the helmet 200, guide cords 110, anchors 140 and body harness 300.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for preventing neck, spinal cord injury and concussion, comprising;

a helmet;

a body harness; and four anchor assemblies separately positioned at front, rear, and right and left side positions and connecting the helmet to the body harness, wherein the anchor assemblies are adjustable to limit cervical rotation, lateral bending, flexion and extension ranges of motion of a wearer to a predetermined set point, each anchor assembly including three guide cords extending from the helmet to an anchor of the anchor assembly, the three guide cords being attached to, but individually adjustable with respect to, the anchor, the anchor comprising a cleat for receiving and securing the guide cords and a cleat seat permanently attached to the body harness, the cleat and cleat seat being detachably coupled to one another, the helmet being detachable from the body harness without adjusting the guide cords secured to the cleat, wherein the cleat and cleat seat are male and female buckle elements.

2. The apparatus of claim of claim 1, wherein the helmet includes grommets configured to receive the guide cords.

3. The apparatus of claim 1, wherein the apparatus is configured to permit a maximum range of motion of 80 degrees for right and left rotation, 45 degrees for right and left lateral flexion, 50 degrees for flexion, and 60 degrees for extension.

4. The apparatus of claim 1, wherein the anchor assembly is configured to distribute linear and rotational acceleration forces experienced by the wearer to the helmet and body harness.

5. The apparatus of claim 1, wherein the cleat seat is attached to the body harness at a location concealed by a jersey worn over the body harness.

* * * * *